US007383794B2

(12) United States Patent
Hlousek et al.

(10) Patent No.: US 7,383,794 B2
(45) Date of Patent: Jun. 10, 2008

(54) INJECTION NOZZLE FOR INTERNAL COMBUSTION MACHINES

(75) Inventors: Jaroslav Hlousek, Golling (AT); Franz Guggenbichler, Kuchl (AT)

(73) Assignee: Robert Bosch GmbH, Stuttgart-Feuerbach (DE)

( * ) Notice: Subject to any disclaimer, the term of this patent is extended or adjusted under 35 U.S.C. 154(b) by 0 days.

(21) Appl. No.: 11/660,973

(22) PCT Filed: Aug. 18, 2005

(86) PCT No.: PCT/AT2005/000330

§ 371 (c)(1),
(2), (4) Date: Feb. 23, 2007

(87) PCT Pub. No.: WO2006/021014

PCT Pub. Date: Mar. 2, 2006

(65) Prior Publication Data

US 2008/0017169 A1 Jan. 24, 2008

(30) Foreign Application Priority Data

Aug. 24, 2004 (AT) ..... A 1424/2004

(51) Int. Cl.
*F01P 3/16* (2006.01)

(52) U.S. Cl. ..... 123/41.33; 123/467; 239/132.3

(58) Field of Classification Search ..... 123/41.31, 123/41.33, 467; 239/132.3, 584–586
See application file for complete search history.

(56) References Cited

U.S. PATENT DOCUMENTS 3,737,100 A * 6/1973 Dreisin ..... 239/132.5
3,945,353 A * 3/1976 Dreisin ..... 123/41.33
4,267,977 A * 5/1981 Stockner et al. ..... 239/132.3
5,400,968 A * 3/1995 Sood ..... 239/132.5
5,740,782 A * 4/1998 Lowi, Jr. ..... 123/446
5,860,394 A * 1/1999 Saito et al. ..... 123/41.31
7,090,145 B2 * 8/2006 Baker et al. ..... 239/132.5

FOREIGN PATENT DOCUMENTS

| | | |
|---|---|---|
| DE | 721753 | 6/1942 |
| DE | 31 41 070 C3 | 4/1983 |
| DE | 197 38 351 A1 | 3/1998 |
| DE | 199 09 451 A1 | 9/2000 |
| EP | 0 961 025 A1 | 12/1999 |

* cited by examiner

*Primary Examiner*—Erick Solis
(74) *Attorney, Agent, or Firm*—Fitch, Even, Tabin & Flannery

(57) ABSTRACT

Within an injection nozzle for the injection of fuels into the combustion chamber of an internal combustion machine the injection nozzle (5) comprising an axially displaceable valve needle (7), which plunges into a control chamber (12) chargeable with pressurized fuel whose pressure is controllable by a control valve (16) opening or closing the at lest one inlet or outlet channel for fuel, channels are arranged in the region of the valve needle (7), which channels are connected with lubricant- or motor-oil lines respectively and can be passed through by lubricant- or motor-oil respectively. Also in the region of the control valve (16) and/or a solenoid actuating the control valve, channels are arranged which are connected with lubricant- or motor-oil lines respectively and can be passed through by lubricant- or motor-oil respectively.

7 Claims, 3 Drawing Sheets

INJECTION NOZZLE FOR INTERNAL COMBUSTION MACHINES

Figure 1:
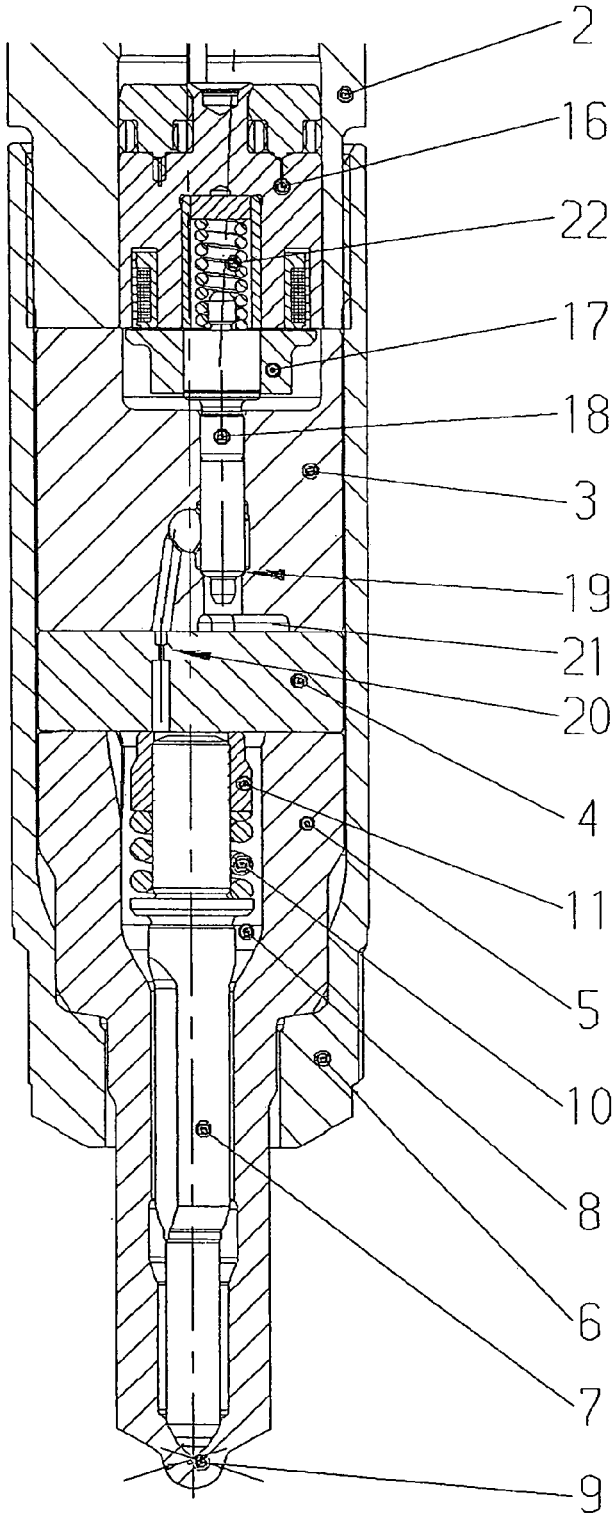
Fig. 1 PRIOR ART

This Application is the National Phase of International Application No. PCT/AT2005/000330 filed Aug. 18, 2005, which designated the U.S. and was not published under PCT Article 21(2) in English, and this application claims, via the aforesaid International Application, the foreign priority benefit of and claims the priority from Austria Application No. A 1424/2004, filed Aug. 24, 2004, the complete disclosures of which are incorporated herein by reference.

The invention relates to an injection nozzle for injecting fuel into the combustion chamber of an internal combustion machine comprising a valve needle being axially displaceable in the injection needle, which valve needle plunges into control chamber being chargeable by pressurized fuel, whose pressure can be controlled by the steering valve opening or closing at least one inlet channel or outlet channel.

Such an injection nozzle has, for example, become known from DE 19738351 A1.

From DE 3141070 C3 another injection nozzle has become known, in which cooling is provided, wherein the cooling channel of the injection nozzle is connected to the lubricating oil system of the motor and empties freely in the cylinder head.

Injectors for common rail systems for injecting fuel with high viscosity into the combustion chamber of internal combustion machines are known in different designs. In the case of heavy oil heating of up to 150° C. is required to reach the necessary injection viscosity. At high portions of abrasively acting solids and high temperature, naturally, wear is increased and thus impairs operating safety.

Basically an injector for a common rail injection system has various parts, which are, as a rule, kept together by a nozzle-clamping nut. The actual injection nozzle comprises a valve needle, which is guided axially displaceable in the nozzle body and showing various free faces, through which fuel can flow from the nozzle anteroom to the needle tip. The valve needle itself features a collar on which a pressure spring firms up and the needle plunges into a control chamber, which is chargeable with pressurized fuel. An inlet channel and an outlet channel may be connected to this control chamber via an inlet choke and an outlet choke, wherein the respective pressure set up in the control chamber together with the force of the pressure spring keeps the valve needle in the closed position. The pressure inside the control chamber can be controlled by a control valve, which is mostly operated by a solenoid. With adequate wiring the opening of the control valve can result in drain of the fuel via a choke so that a decline of the hydraulic retaining force on the end face of the valve needle plunging into the control chamber results in opening of the valve needle. In this manner, the fuel subsequently can, via the injection orifices, get into the combustion chamber of the motor.

In addition to an outlet choke, in most of the cases also an inlet choke is provided, whereby the opening speed of the valve needle is determined by the difference in flux between the inlet and the outlet choke. When the control valve is being closed, the drain passage of the fuel through the outlet choke is blocked and pressure is again built up and closing of the valve needle is effectuated.

The invention aims to provide an embodiment of such a control valve, which remains accident-insensitive at high temperatures and also with highly viscous oils and which shows superior reliability even under extreme conditions. To solve this object, the embodiment is devised such that channels are arranged in the region of the valve needle, which are connected to lubricant lines or motor oil lines respectively and are passable by lubricant or motor oil respectively and that also in the region of the control valve and/or of a solenoid actuating the control valve channels are arranged, which are connected to lubricant lines or motor oil lines respectively and are passable by lubricant or motor oil respectively.

A respective guiding of lubricant channels through the main nozzle body results in a basic cooling of the injector, whereby especially exposed parts, like for instance the valve needle and the valve seat, can be flushed by such a coolant in an especially advantageous way. To this end the embodiment is advantageously devised such that a tapping line with lubricant, and in particular motor oil, empties at the valve needle, which cooperates with the valve seat. By means of lubricant being guided in such a way at the periphery of the valve needle it is not only possible to cool the valve needle but simultaneously, by adequate design on the outer face of the valve needle, to flush the guidance of the valve needle in the nozzle body in order to flush away possible accumulations of impurities in the heavy oil. The employed motor oil thus not only serves for the cooling of sensitive component parts but simultaneously for the flushing of the valve needle in the nozzle body.

The region of the valve seat can hereby be devised such that the valve seat of the valve is arranged in a bushing made of wear resistant material and separated from the nozzle body, whereby the separate valve bushing can be floatingly supported in a cavity of the nozzle body, thus resulting in a particularly simple exchangeability of possible worn out component parts.

Such a valve bushing allows for the arrangement of a set of additional control channels in the nozzle body carrying the valve bushing without leading to undesired fatigues of the material. Hence, the embodiment can be devised such that the valve bushing at its outer cylinder faces and/or its end faces respectively features notches or chamfers thereby forming channels to an inlet or outlet choke for fuel into or out of the control chamber, thus providing a set of additional functions by these so formed channels. For the inventive cooling the embodiment can advantageously be devised such that the valve needle features notches or grooves at its shell, which cooperate with tapping lines emptying at the shell of the valve needle, whereby such a tapping line can serve for the cooling and lubrication by means of motor oil. It is equally feasible to guide leak fuel in a pressure-free drain.

In the following, the invention will be exemplified by embodiments depicted by the schematic drawings.

Figure 2:
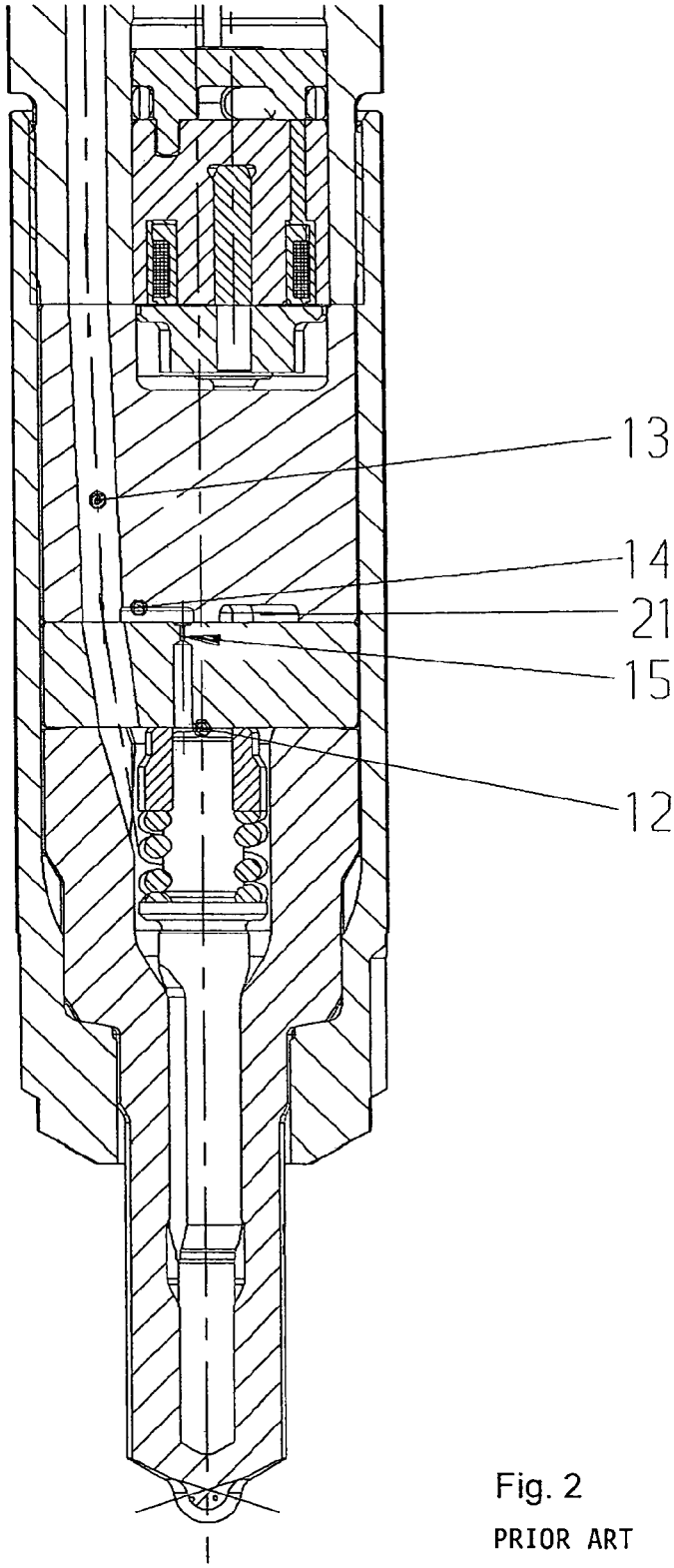
Fig. 2 PRIOR ART
Figure 3:
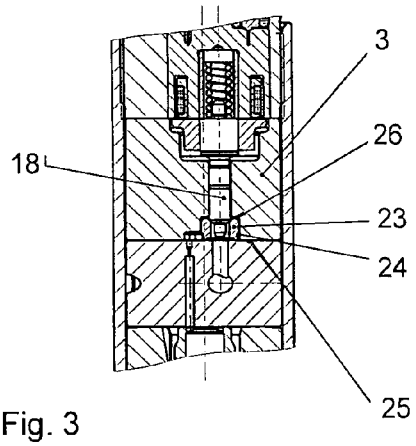
Figure 4:
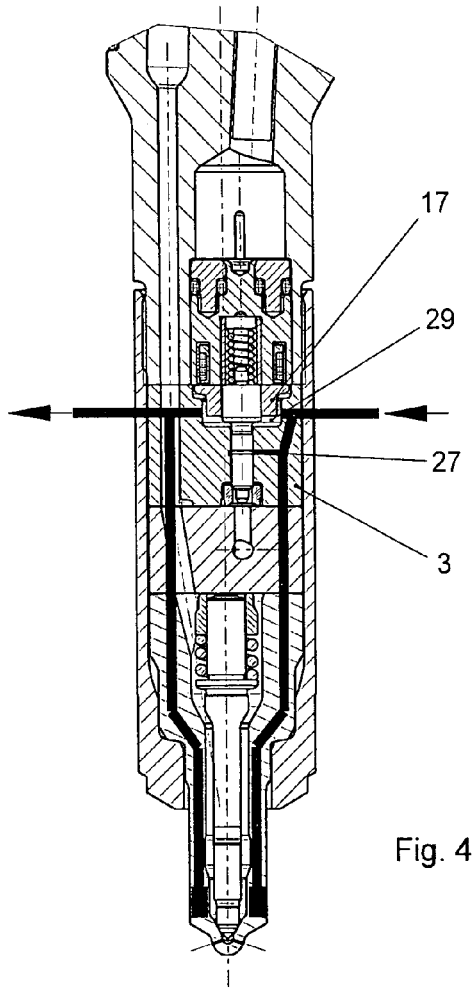
Figure 5:
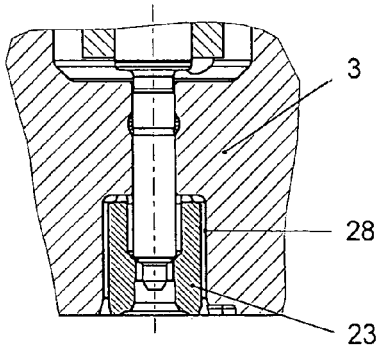
Figure 6:
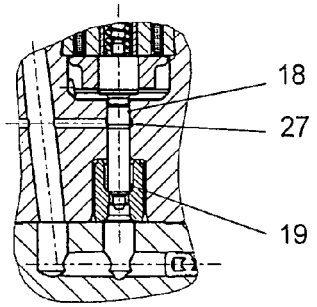
Figure 7:
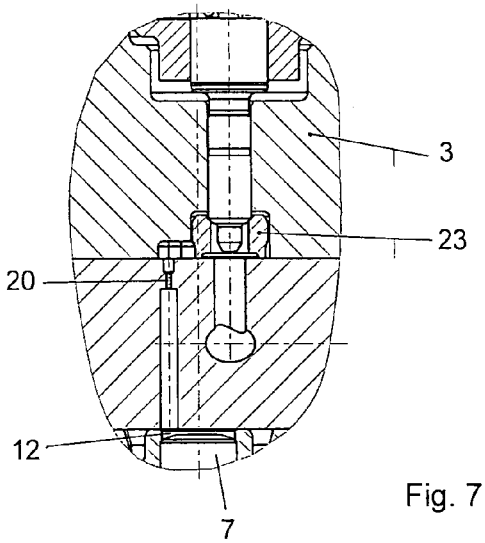

In these FIGS. 1 and 2 show the basic configuration of an injector according to prior art, FIG. 3 shows a sectional view of a first inventive embodiment of the control valve, FIG. 4 shows a depiction of the injector with an inventive control valve and channels for the cooling of the injector, FIG. 5 shows a sectional view of a nozzle body with a pressed in valve bushing, FIG. 6 shows an enlarged depiction of the control valve, as it is used in FIG. 4 and FIG. 7 shows the embodiment of the nozzle body with a swimming valve bushing for the control valve.

In FIG. 1 an injector 1 is shown having an injector body 2, a valve body 3, a middle plate 4 and an injector nozzle 5. All these component parts are kept together by a nozzle-clamping nut 6. The injector nozzle 5 hereby comprises a valve needle 7, which is longitudinally relocatable guided in the nozzle body of the injection nozzle 5 and which shows several free faces, through which fuel from a nozzle anteroom 8 can flow to the needle tip. By an opening movement of the valve needle 7 fuel is being injected into the combustion chamber of the internal combustion machine via several injection orifices 9.

A collar is arranged at the valve needle 7, on which the pressure spring 10 is supported. The other end of the pressure spring 10 is supported on a steering casing 11, which in term contacts the lower side of the middle plate 4. The steering casing 11 together with the upper end face of the valve needle 7 and the lower side of the middle plate 4 defines a control chamber 12. The pressure present in the control chamber 12 is decisive for the control of the movement of the valve needle. Via a fuel inlet board 13, which can be seen in FIG. 2, the fuel pressure becomes effective in a nozzle anteroom 8, where the pressure exerts force on a pressure shoulder of the valve needle 7 in the opening direction of the valve needle 7. On the other hand this fuel pressure via the inlet channel 14 and the inlet choke 15 as shown in FIG. 2 is effective in the control chamber 12 and assisted by force of the pressure spring 10 keeps the valve needle 7 in its closing position.

When subsequently a solenoid 16 is actuated a solenoid anchor 17 as well as a valve needle 18, which is connected to the solenoid anchor 17, are lifted and a valve seat 19 is opened. In this manner fuel can flow off from the control chamber 12 through an outlet choke 20 and the opened valve seat 19 in a pressure-free drain channel 21. The so produced fall of the hydraulic force upon the upper end face of the valve needle 7 results in an opening of the valve needle 7. In this manner fuel from the nozzle anteroom reaches the combustion chamber of the motor via the injection orifices 9. In an open state of the injection nozzle 5 high-pressure fuel simultaneously flows through the inlet choke 15 to the control chamber 12 and via the outlet choke 20 a slightly bigger amount is drained. The so called control amount is drained pressure-free into the drain channel 21 and is taken additionally to the injection amount from the common rail. The opening speed of the valve needle 7 is determined by the flux difference between the inlet choke 15 and the outlet choke 20.

As soon as solenoid 16 is turned off, the solenoid anchor 17 is pressed down by the force of a pressure spring 22 and the valve needle 18 is pressed onto the valve seat 19. In this manner the drain path of the fuel is blocked by the outlet choke 20. Fuel pressure in the control chamber 12 is built up anew by the inlet choke 15 and produces an additional closing force, which exceeds the hydraulic force on the pressure shoulder of the valve needle 7, which force is decreased by the force of the pressure spring 10. The valve needle 7 closes the path towards the injection orifices 9, thereby ending the injection operation.

The embodiment of an injector depicted in FIGS. 1 and 2 is in principal apt for fuels with low viscosity. With highly viscose fuels preheating is required which demands heating temperatures for fuel of up to 150° C. Moreover highly-viscose fuels mostly have a higher portion of impurities, whereby additionally to the required heating of the fuel warming of the solenoid valve by the control current results in excessive heating and possible destruction of the component part. Impurities of the fuel would shortly result in clamping off the valve needle and in excessive wear of the valve needle and the valve seat.

To meet this disadvantage the inventive embodiment of the control valve as shown in FIG. 3 was created. Here the valve seat is arranged in a valve bushing 23, which is accommodated in a cylindrically clear room 24 of the valve body 3. The valve bushing may hereby either be pressed into the valve body 3 as it will be elucidated in more detail with the description according to FIG. 5 or be guided floatingly between the face 25 in the valve body 3, which limits the room 24 towards the upside and the upper end face of the middle plate 4. In such a case a cone 26 at the lower end of the valve needle 18 effects the centering. This cone 26 is pressed onto the valve seat in the valve bushing 23, whereby the floating valve 23 is constantly in contact with the middle plate as a result of the hydraulic forces acting on it, also in an open state of the valve.

The valve bushing 23 can be crafted from especially wear resistant hard metal whereby, when excessive wear at the valve seat 19 of the valve bushing 23 is monitored, cost saving substitution together with the valve needle 18 is possible.

As already mentioned, warming of the fuel is required with combustion machines operated with heavy oil, whereby additional heat stress on the common rail injectors become effective. In addition to the already up to 150° C. pre heated fuel the nozzle tip protruding into the combustion chamber experiences heating by the hot combustion gases. Also the control current for the solenoid valve provides additional warming. As can be seen in FIG. 4, cooling in especially advantageous manner is provided in this case, whereby the injector is constantly flushed with motor oil. The flushing channels in the injector are coloured black in FIG. 4, whereby the motor oil reaches via these channels the region of the nozzle tip as well as a chamber 29 of the valve body 3, in which the solenoid anchor 17 of the solenoid valve is arranged. Additionally an annual cut-in 27 can be seen at which motor oil in the valve body 3 is directed into the guidance of the valve needle 18 and thus cleans this region from possible accumulation and impurities in the heavy oil.

In FIG. 5 a valve body is shown in a sectional view, in which the valve bushing 23 is pressed-in. Channels for the feed of the high-pressure fuel to the inlet choke 15 and for the drain of the fuel via the outlet choke 20 to the valve seat 19 of the valve bushing 23 are incorporated into the lower side of the valve body 3. At the cylindrical outer contour of the valve bushing 23 several faces are provided, which together with grooves on the upper side of the valve bushing 23 constitute a connection from the outlet choke 20 to the valve seat by at least one drain channel 28 formed and limited by the free faces.

In FIG. 6 a valve body is shown in a sectional view, whereby an annular cut-in 27 can be seen, which allows for the guiding of leak fuel coming up from the valve seat 19 and of the motor oil leaking alongside the valve needle 18 from the upper side into a pressure free drain.

In FIG. 7 the section of a valve body with a floating valve bushing is depicted. The guiding of the fuel from the outlet choke to the valve seat of the valve bushing herein is effected by a cylindrical space between the valve body and the floating valve bushing 23.

The invention claimed is:

1. Injection nozzle for the injection of fuels into the combustion chamber of an internal combustion machine having an axially displaceable valve needle inside an injector nozzle, which valve needle plunges into a control chamber chargeable with pressurized fuel, which pressure is controllable by the control valve opening or closing at least one inlet or outlet channel for fuel, characterized in that the channels are arranged in the region of the valve needle, which are connected with lubricant- or motor-oil lines respectively and which can be passed through by lubricant- or motor-oil respectively and that also in the region of the control valve and/or of a solenoid actuating the control valve channels are arranged, which channels are connected to lubricant- or motor-oil lines respectively and can be passed through by lubricant- or motor-oil respectively and that a tapping line with lubricant oil and in particular motor oil opens at the valve needle cooperating with the valve seat.

2. Control valve according to claim 1, characterized in that the valve seat of the valve is arranged in a valve bushing of wear-resistant material separate from the valve body.

3. Control valve according to claim 1, characterized in that the valve needle, at its periphery, features notches or grooves which cooperate with tapping lines opening out at the periphery of the valve needle.

4. Control valve according to claim 1, characterized in that the valve needle at periphery features, notches or grooves which cooperate with tapping lines opening out at the periphery of the valve needle.

5. Control valve according to claim 2, characterized in that the valve needle, at its periphery, features notches or grooves which cooperate with tapping lines opening out at the periphery of the valve needle.

6. Control valve according to claim 2, characterized in that the valve needle at periphery features, notches or grooves which cooperate with tapping lines opening out at the periphery of the valve needle.

7. Control valve according to claim 3, characterized in that the valve needle at periphery features, notches or grooves which cooperate with tapping lines opening out at the periphery of the valve needle.

* * * * *